US011046076B2

(12) United States Patent
Moriyama

(10) Patent No.: US 11,046,076 B2
(45) Date of Patent: Jun. 29, 2021

(54) LIQUID DISCHARGE HEAD AND LIQUID DISCHARGE APPARATUS

(71) Applicant: SEIKO EPSON CORPORATION, Tokyo (JP)

(72) Inventor: Keita Moriyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/795,891

(22) Filed: Feb. 20, 2020

(65) Prior Publication Data

US 2020/0269576 A1 Aug. 27, 2020

(30) Foreign Application Priority Data

Feb. 22, 2019 (JP) ..... JP2019-030020

(51) Int. Cl.
*B41J 2/14* (2006.01)

(52) U.S. Cl.
CPC ..... *B41J 2/14233* (2013.01); *B41J 2/14145* (2013.01); *B41J 2/14209* (2013.01); *B41J 2002/14419* (2013.01); *B41J 2202/07* (2013.01); *B41J 2202/11* (2013.01); *B41J 2202/12* (2013.01)

(58) Field of Classification Search
CPC ..... B41J 2/14233; B41J 2/14145; B41J 2/14209; B41J 2202/11; B41J 2202/07; B41J 2202/12; B41J 2002/14419
See application file for complete search history.

(56) References Cited

U.S. PATENT DOCUMENTS 10,836,160 B2 * 11/2020 Mizuno ..... B41J 2/04581
2015/0224786 A1 8/2015 Otsuka et al.

FOREIGN PATENT DOCUMENTS

JP 2015-147365 A 8/2015

* cited by examiner

*Primary Examiner* — Geoffrey S Mruk
(74) *Attorney, Agent, or Firm* — Workman Nydegger

(57) ABSTRACT

A liquid discharge head includes: a liquid chamber; a supply flow path supplying liquid to the liquid chamber; a discharging flow path being provided away from the supply flow path in a horizontal direction and discharging the liquid from the liquid chamber; a first-connecting-flow-path communicating between the liquid chamber and the supply flow path; and nozzles for discharging the liquid supplied from the liquid chamber. The first-connecting-flow-path includes a first-supply-bottom-surface inclined downward with respect to a horizontal plane at a first-angle from the supply flow path toward the liquid chamber, and a second-supply-bottom-surface located between the first-supply-bottom-surface and the liquid chamber and inclined downward with respect to the horizontal plane at a second-angle from the first-supply-bottom-surface toward the liquid chamber. The first-angle is greater than or equal to 0 degrees and is less than 90 degrees, and the second-angle is greater than the first-angle and is less than 90 degrees.

17 Claims, 9 Drawing Sheets

LIQUID DISCHARGE HEAD AND LIQUID DISCHARGE APPARATUS

The present application is based on, and claims priority from JP Application Serial Number 2019-030020, filed Feb. 22, 2019, the disclosure of which is hereby incorporated by reference herein in its entirety.

BACKGROUND

1. Technical Field

The present disclosure relates to a liquid discharge head and a liquid discharge apparatus.

2. Related Art

A liquid discharge head having a liquid flow path and a liquid storing space has been proposed. JP-A-2015-147365 discloses a liquid ejecting apparatus having a liquid chamber communicating with nozzles, a common liquid chamber that stores liquid to be supplied to the liquid chamber, a supply flow path through which the liquid is supplied to the common liquid chamber, and a discharging flow path through which the liquid is discharged from the common liquid chamber. The liquid discharged from the common liquid chamber to the discharging flow path is circulated to the common liquid chamber through the supply flow path by a circulation pump.

In the configuration in which the liquid is circulated as in JP-A-2015-147365, depending on the shape of the common liquid chamber, a liquid flow directed from the common liquid chamber to the liquid chamber may be blocked, or bubbles in the liquid may flow in the liquid chamber along with the liquid flow.

SUMMARY

According to an aspect of the present disclosure, there is provided a liquid discharge head including: a liquid chamber that stores liquid; a supply flow path through which the liquid is supplied to the liquid chamber; a discharging flow path that is provided at a position away from the supply flow path in a horizontal direction and through which the liquid in the liquid chamber is discharged; a first connecting flow path that communicates between the liquid chamber and the supply flow path; and an energy generating chamber to which the liquid is supplied from the liquid chamber and that generates energy for discharging the liquid. The first connecting flow path has a bottom surface including a first supply bottom surface inclined downward with respect to a horizontal plane at a first angle from the supply flow path toward the liquid chamber, and a second supply bottom surface located between the first supply bottom surface and the liquid chamber and inclined downward with respect to the horizontal plane at a second angle from the first supply bottom surface toward the liquid chamber. The first angle is greater than or equal to 0 degrees and is less than 90 degrees, and the second angle is an angle greater than the first angle and is less than 90 degrees.

According to another aspect of the present disclosure, there is provided a liquid discharge apparatus including a liquid discharge head that discharges liquid, and a controller that controls the liquid discharge head. The liquid discharge head includes: a liquid chamber that stores liquid; a supply flow path through which the liquid is supplied to the liquid chamber; a discharging flow path that is provided at a position away from the supply flow path in a horizontal direction and through which the liquid in the liquid chamber is discharged; a first connecting flow path that communicates between the liquid chamber and the supply flow path; and an energy generating chamber to which the liquid is supplied from the liquid chamber and that generates energy for discharging the liquid. The first connecting flow path has a bottom surface including a first supply bottom surface inclined downward with respect to a horizontal plane at a first angle from the supply flow path toward the liquid chamber, and a second supply bottom surface located between the first supply bottom surface and the liquid chamber and inclined downward with respect to the horizontal plane at a second angle from the first supply bottom surface toward the liquid chamber. The first angle is greater than or equal to 0 degrees and is less than 90 degrees, and the second angle is an angle greater than the first angle and is less than 90 degrees.

DESCRIPTION OF EXEMPLARY EMBODIMENTS

A. First Embodiment

Figure 1:
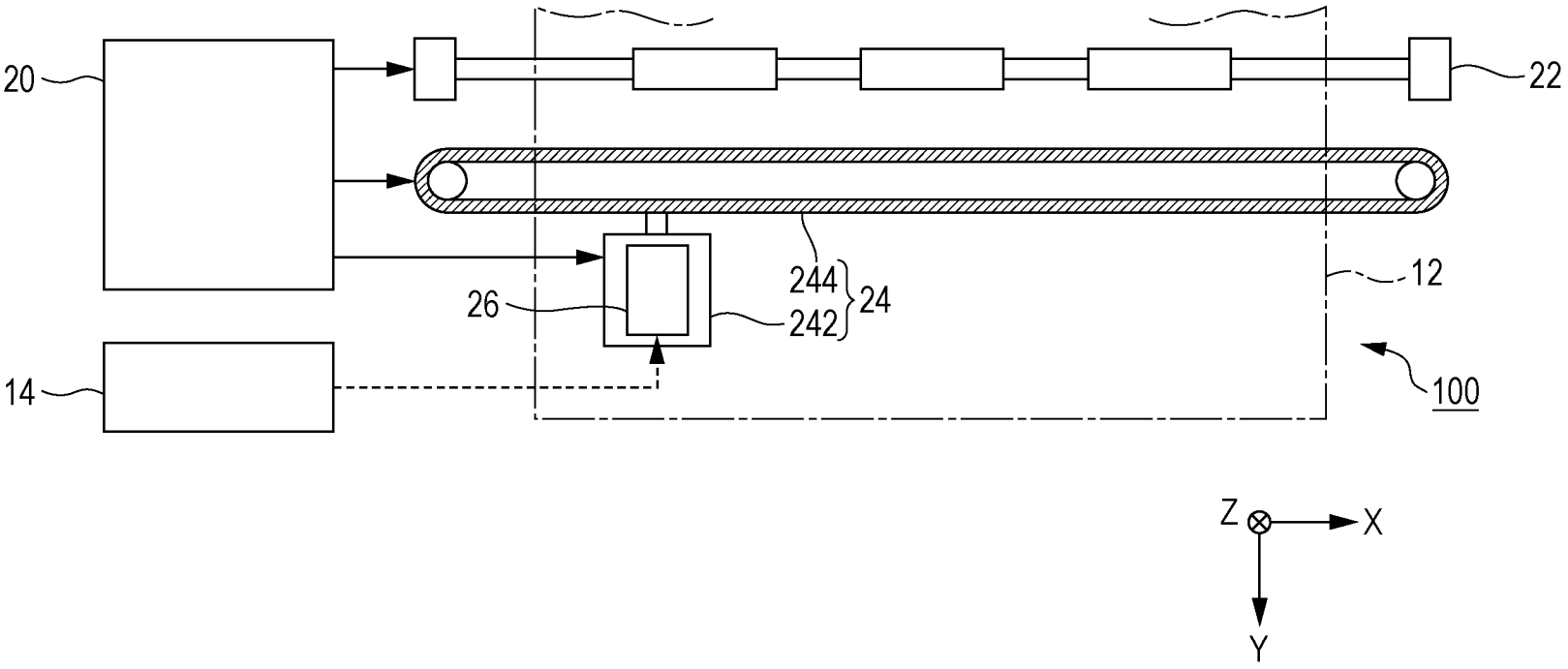
FIG. 1 shows a configuration of a liquid discharge apparatus according to a first embodiment.

FIG. 1 shows an example configuration of a liquid discharge apparatus 100 according to a first embodiment. The liquid discharge apparatus 100 according to the first embodiment is an ink jet printing apparatus that ejects ink, serving as an example liquid, onto a medium 12. Typically, the medium 12 is printing paper. However, the medium 12 may be other printing objects that are made of desired materials, such as resin film, cloth, etc. As shown in FIG. 1, a liquid container 14 that stores ink is disposed in the liquid discharge apparatus 100. For example, a cartridge that is removably attached to the liquid discharge apparatus 100, a bag-like ink pack made of a flexible film, or a refillable ink tank is used as the liquid container 14.

As shown in FIG. 1, the liquid discharge apparatus 100 includes a control unit 20, a transport mechanism 22, a moving mechanism 24, and a liquid discharge head 26. The control unit 20 includes a processing circuit, such as a central processing unit (CPU) or a field programmable gate array (FPGA), and a memory circuit, such as a semiconductor memory, and performs centralized control of the components of the liquid discharge apparatus 100. The control unit 20 is an example controller. The transport mechanism 22 transports the medium 12 in the Y-axis direction under the control of the control unit 20.

The moving mechanism 24 reciprocates the liquid discharge head 26 in the X-axis direction under the control of the control unit 20. The X axis intersects the Y axis, along which the medium 12 is transported. Typically, the X axis and the Y axis are perpendicular to each other. The moving mechanism 24 according to the first embodiment includes a substantially box-shaped transport body 242 that accommodates a liquid discharge head 26, and a transport belt 244 to which the transport body 242 is fixed. The transport body 242 is, for example, a carriage. It is also possible to employ a configuration in which a plurality of liquid discharge heads 26 are loaded on the transport body 242, or a configuration in which the liquid container 14 is loaded on the transport body 242, together with the liquid discharge head 26.

The liquid discharge head 26 ejects ink, supplied from the liquid container 14, onto the medium 12 through a plurality of nozzles under the control of the control unit 20. As a result of the liquid discharge head 26 ejecting ink onto the medium 12 while the transport mechanism 22 transports the medium 12 and while the transport body 242 reciprocates, a desired image is formed on the surface of the medium 12.

Figure 2:
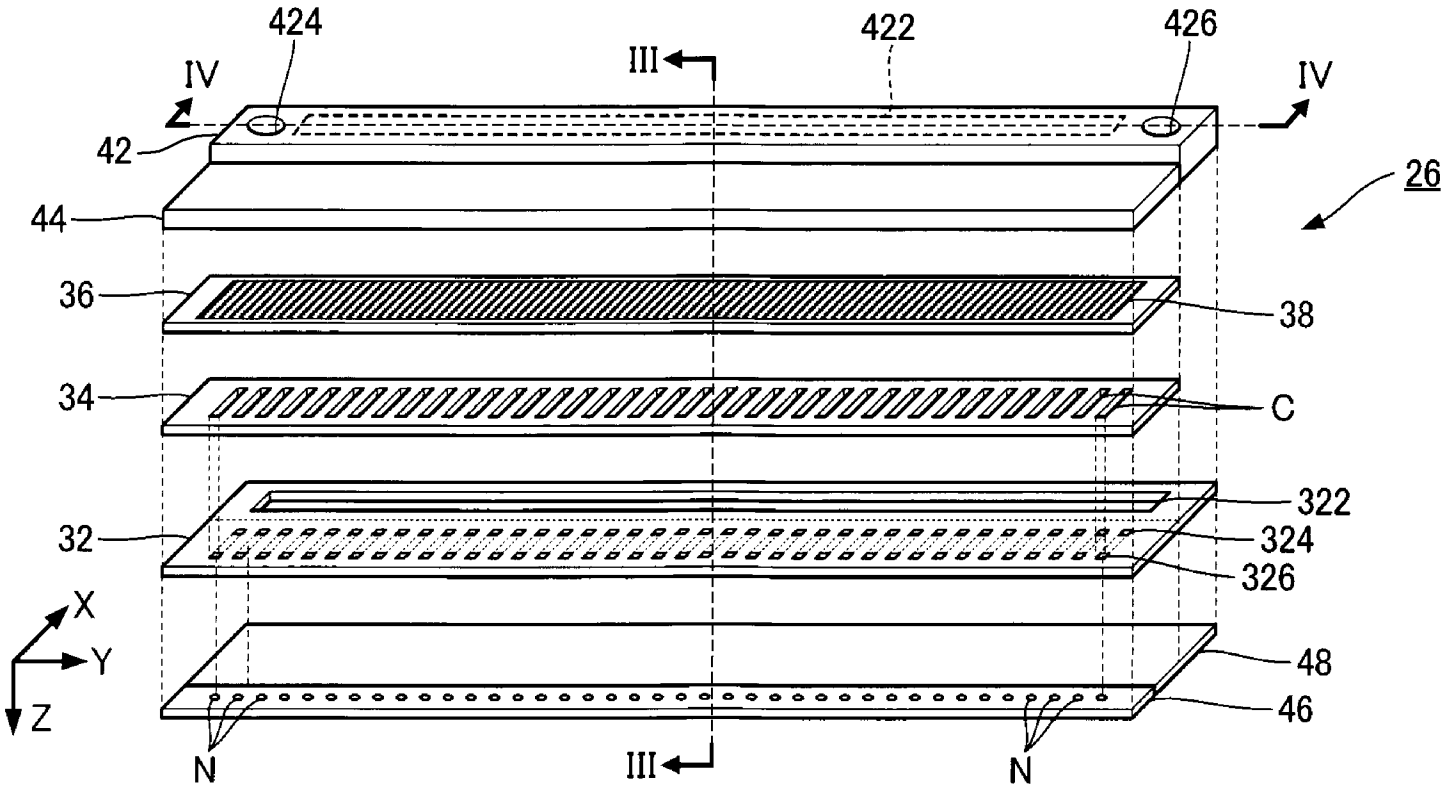
FIG. 2 is an exploded perspective view of a liquid discharge head.
Figure 3:
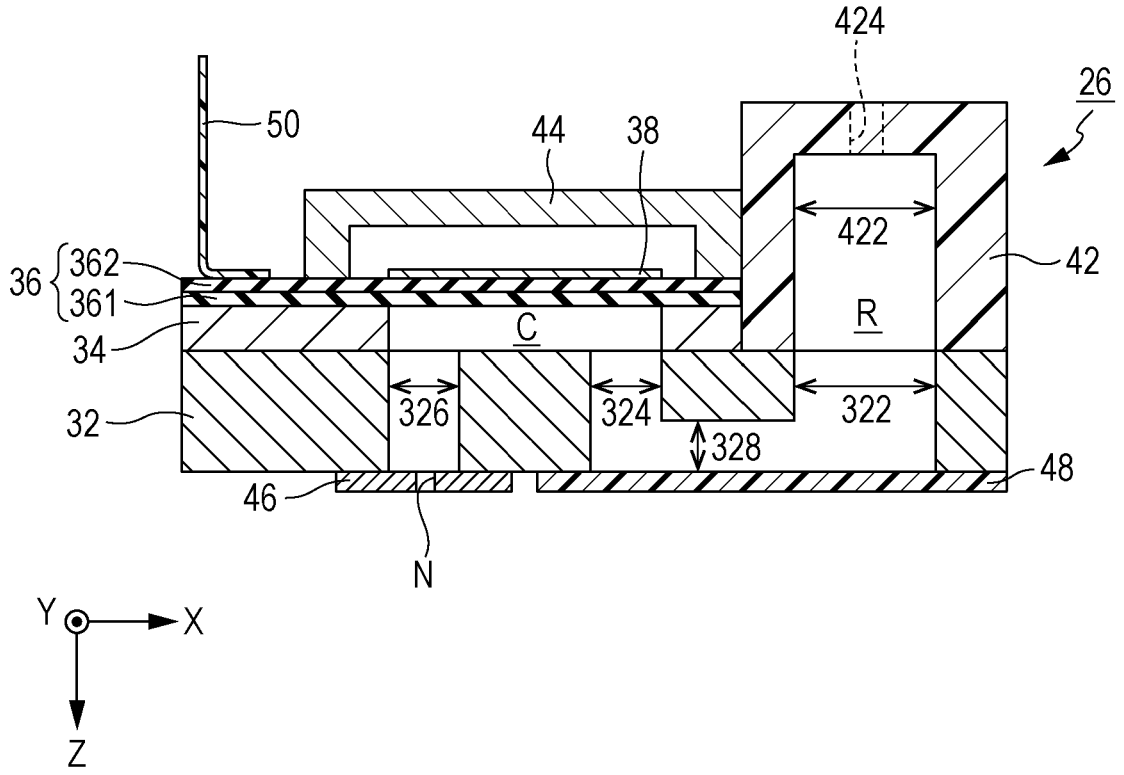
FIG. 3 is a sectional view of the liquid discharge head, taken along line III-III in FIG. 2.

FIG. 2 is an exploded perspective view of the liquid discharge head 26, and FIG. 3 is a sectional view taken along line III-III in FIG. 2. As shown in FIG. 2, an axis perpendicular to an X-Y plane will be referred to as a Z axis. Typically, the Z axis is parallel to the vertical direction.

As shown in FIGS. 2 and 3, the liquid discharge head 26 includes a substantially rectangular flow-path substrate 32 elongated in the Y-axis direction. A pressure-chamber substrate 34, a vibration plate 36, a plurality of piezoelectric elements 38, a housing portion 42, and a sealing member 44 are provided on the −Z-side surface of the flow-path substrate 32. A nozzle plate 46 and a damper 48 are provided on the +Z-side surface of the flow-path substrate 32. These components of the liquid discharge head 26 are generally plate-like members elongated in the Y-axis direction, similarly to the flow-path substrate 32, and are bonded together by using, for example, an adhesive.

As shown in FIG. 2, the nozzle plate 46 is a plate-like member having a plurality of nozzles N arrayed along the Y axis. The nozzles N are through-holes through which the ink passes. The flow-path substrate 32, the pressure-chamber substrate 34, and the nozzle plate 46 are formed by processing, for example, silicon (Si) single-crystal substrates by using a semiconductor manufacturing technique, such as etching. However, the respective components of the liquid discharge head 26 may be made of any desired material by using any desired manufacturing method. The Y axis can also be said as an axis along which the plurality of nozzles N are arrayed.

The flow-path substrate 32 is a plate-like member that forms ink flow paths. As shown in FIGS. 2 and 3, the flow-path substrate 32 has a first liquid chamber 322, first communicating flow paths 324, and second communicating flow paths 326. The first liquid chamber 322 is an elongated through-hole provided so as to correspond to the plurality of nozzles N and so as to extend along the Y axis in plan view as viewed in the Z-axis direction. The first communicating flow paths 324 and the second communicating flow paths 326 are through-holes provided so as to correspond to the respective nozzles N. As shown in FIG. 3, a relay flow path 328 extending so as to correspond to the plurality of first communicating flow paths 324 is formed on the +Z-side surface of the flow-path substrate 32. The relay flow path 328 communicates between the first liquid chamber 322 and the plurality of first communicating flow paths 324.

Figure 4:
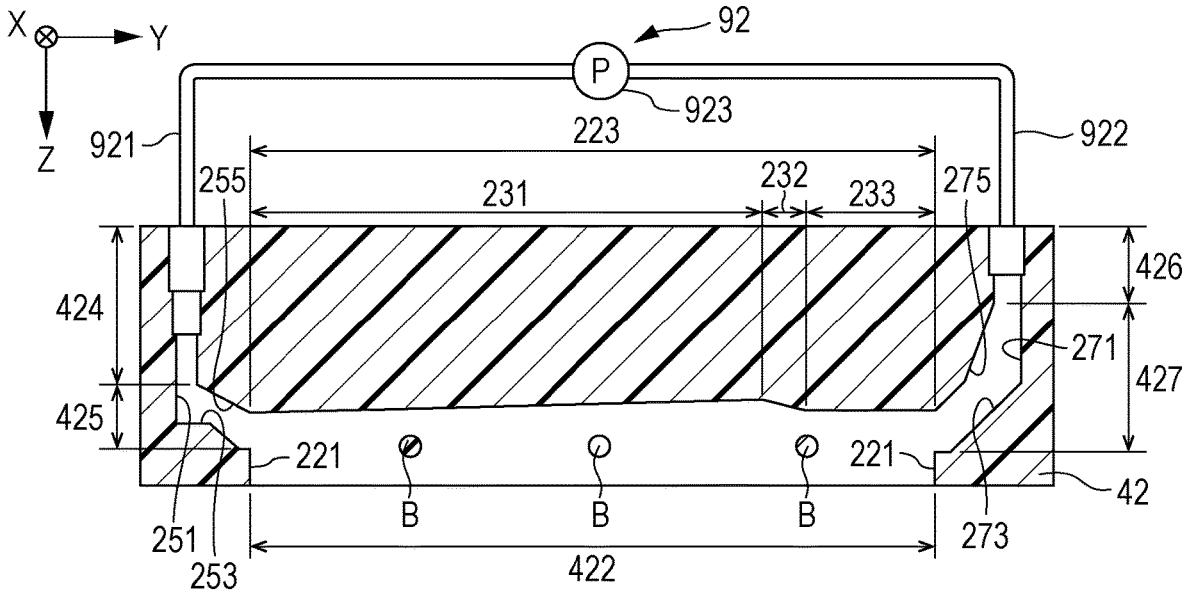
FIG. 4 is a sectional view taken along line IV-IV in FIG. 2.

FIG. 4 is a sectional view of the housing portion 42, taken along line IV-IV in FIG. 2. The housing portion 42 is a structure produced by, for example, injection-molding a resin material and is fixed to a −Z-side surface of the flow-path substrate 32. As shown in FIG. 4, the housing portion 42 includes a second liquid chamber 422, a supply flow path 424, a discharging flow path 426, a first connecting flow path 425, and a second connecting flow path 427. As shown in FIGS. 3 and 4, the second liquid chamber 422 is a recess extending along the Y axis and having an external shape corresponding to the first liquid chamber 322 in the flow-path substrate 32. As can be seen from FIG. 3, a space communicating between the first liquid chamber 322 in the flow-path substrate 32 and the second liquid chamber 422 in the housing portion 42 serves as a liquid reservoir R.

In FIG. 4, a plurality of beam members B are formed in the second liquid chamber 422 so as to be spaced apart in the Y-axis direction. The beam members B are formed as integral parts of the housing portion 42. The beam members B extend between portions of an inner circumferential surface 221 of the second liquid chamber 422 facing each other in the X-axis direction, so as to be parallel to the X axis. By forming the plurality of beam members B, the mechanical strength of the housing portion 42 is improved.

The supply flow path 424 is a flow path through which the ink is supplied to the second liquid chamber 422, and the discharging flow path 426 is a flow path through which the ink is discharged from the second liquid chamber 422. The supply flow path 424 and the discharging flow path 426 are formed in a linear shape so as to extend in the +Z-axis direction from the surface of the housing portion 42 farther from the flow-path substrate 32. As shown in FIG. 2, the supply flow path 424 and the discharging flow path 426 are provided at positions away from each other in the horizontal direction. For example, the supply flow path 424 is formed near the −Y-side end of the housing portion 42, and the discharging flow path 426 is formed near the +Y-side end of the housing portion 42. In plan view as viewed in the Z-axis direction, the second liquid chamber 422 is located between the supply flow path 424 and the discharging flow path 426.

The first connecting flow path 425 communicates between the second liquid chamber 422 and the supply flow path 424. In other words, the first connecting flow path 425 is formed so as to extend from the supply flow path 424 to the second liquid chamber 422. The +Z-side end of the supply flow path 424 and the −Y-side end of the second liquid chamber 422 are joined to each other by the first connecting flow path 425. The ink supplied from the liquid container 14 and passing through the supply flow path 424 and the first connecting flow path 425 is stored in the liquid reservoir R.

The second connecting flow path 427 communicates between the second liquid chamber 422 and the discharging flow path 426. In other words, the second connecting flow path 427 is formed so as to extend from the second liquid chamber 422 to the discharging flow path 426. The +Z-side end of the discharging flow path 426 and the +Y-side end of the second liquid chamber 422 are joined to each other by the second connecting flow path 427.

As shown in FIG. 4, the liquid discharge apparatus 100 includes a circulation mechanism 92 for circulating the ink in the liquid reservoir R. The circulation mechanism 92 circulates the ink discharged from the liquid reservoir R to the liquid reservoir R. The circulation mechanism 92 includes, for example, a first flow path 921, a second flow path 922, and a circulation pump 923.

The first flow path 921 is a flow path through which the ink is supplied to the supply flow path 424 and joins the supply flow path 424. The ink supplied from the first flow path 921 to the supply flow path 424 passes through the first connecting flow path 425 and is stored in the second liquid chamber 422. The second flow path 922 is a flow path through which the ink is discharged from the discharging flow path 426 and joins the discharging flow path 426. The ink flowing from the second liquid chamber 422 to the second connecting flow path 427 is discharged from the discharging flow path 426 to the second flow path 922. The circulation pump 923 is a pressure-feed mechanism that feeds the ink supplied from the second flow path 922 to the first flow path 921. In other words, the ink discharged from the liquid reservoir R is circulated to the supply flow path 424 through the second flow path 922, the circulation pump 923, and the first flow path 921.

As is understood from the description above, in the ink supplied from the first flow path 921 to the liquid reservoir R, the ink that is not ejected from the nozzles N is discharged into the second flow path 922 and is circulated to the first flow path 921 by the circulation pump 923. In other words, the ink inside the liquid discharge head 26 circulates.

The damper 48 in FIGS. 2 and 3 absorbs pressure fluctuations in the liquid reservoir R and includes, for example, an elastically deformable flexible sheet member. More specifically, the damper 48 is disposed on the +Z-side surface of the flow-path substrate 32 so as to close the first liquid chamber 322, the relay flow path 328, and the plurality of first communicating flow paths 324 in the flow-path substrate 32 and constitute the bottom surface of the liquid reservoir R.

As shown in FIGS. 2 and 3, the pressure-chamber substrate 34 is a plate-like member having a plurality of pressure chambers C corresponding to different nozzles N. The plurality of pressure chambers C are arrayed along the Y axis. Each pressure chamber C is an elongated opening extending along the X axis in plan view. The end of the pressure chamber C in the +X-axis direction overlaps one first communicating flow path 324 in the flow-path substrate 32 in plan view, and the end of the pressure chamber C in the −X-axis direction overlaps one second communicating flow path 326 in the flow-path substrate 32 in plan view.

The vibration plate 36 is provided on the surface of the pressure-chamber substrate 34 farther from the flow-path substrate 32. The vibration plate 36 is an elastically deformable plate-like member. As shown in FIG. 3, the vibration plate 36 according to the first embodiment includes a first layer 361 and a second layer 362. The second layer 362 is located on the opposite side of the first layer 361 from the pressure-chamber substrate 34. The first layer 361 is an elastic film made of an elastic material, such as silicon oxide ($SiO_2$), and the second layer 362 is an insulating film made of an insulating material, such as zirconium oxide ($ZrO_2$). It is possible to form a portion or the entirety of the pressure-chamber substrate 34 and the vibration plate 36 as a single component by selectively removing, in the thickness direction, a portion of the plate-like member having a certain thickness, the portion corresponding to the pressure chambers C.

As is understood from FIG. 3, the flow-path substrate 32 and the vibration plate 36 face each other inside each pressure chamber C with a space therebetween. The pressure chamber C is located between the flow-path substrate 32 and the vibration plate 36 and applies pressure to the ink in the pressure chamber C. The ink stored in the liquid reservoir R flows from the relay flow path 328 into the respective first communicating flow paths 324 and is supplied and poured into the plurality of pressure chambers C in parallel.

As shown in FIGS. 2 and 3, the plurality of piezoelectric elements 38 corresponding to the different nozzles N are disposed on the surface of the vibration plate 36 farther from the pressure chambers C. The piezoelectric elements 38 are actuators that are deformed by receiving the supply of driving signals and have an elongated shape extending along the X axis in plan view. The plurality of piezoelectric elements 38 are arrayed along the Y axis so as to correspond to the plurality of pressure chambers C. When the vibration plate 36 vibrates in response to the deformation of the piezoelectric elements 38, the pressures in the pressure chambers C fluctuate, ejecting the ink in the pressure chambers C through the second communicating flow paths 326 and the nozzles N. In other words, the pressure chambers C generate pressure for discharging ink. The pressure chambers C are an example of energy generating chambers.

The sealing member 44 shown in FIGS. 2 and 3 is a structure for protecting the plurality of piezoelectric elements 38 and for increasing the mechanical strength of the pressure-chamber substrate 34 and the vibration plate 36. The sealing member 44 is fixed to the surface of the vibration plate 36 with, for example, an adhesive. The plurality of piezoelectric elements 38 are accommodated in a recess formed in the surface of the sealing member 44 facing the vibration plate 36.

As shown in FIG. 3, for example, a wiring substrate 50 is joined to the surface of the vibration plate 36. The wiring substrate 50 is a surface-mounted component on which a plurality of wires (not shown) for electrically connecting the control unit 20 and the liquid discharge head 26 are formed. For example, a flexible wiring substrate 50, such as a flexible printed circuit (FPC), a flexible flat cable (FFC), or the like, is suitably employed. Driving signals for driving the piezoelectric elements 38 are supplied from the wiring substrate 50 to the piezoelectric elements 38.

Figure 5:
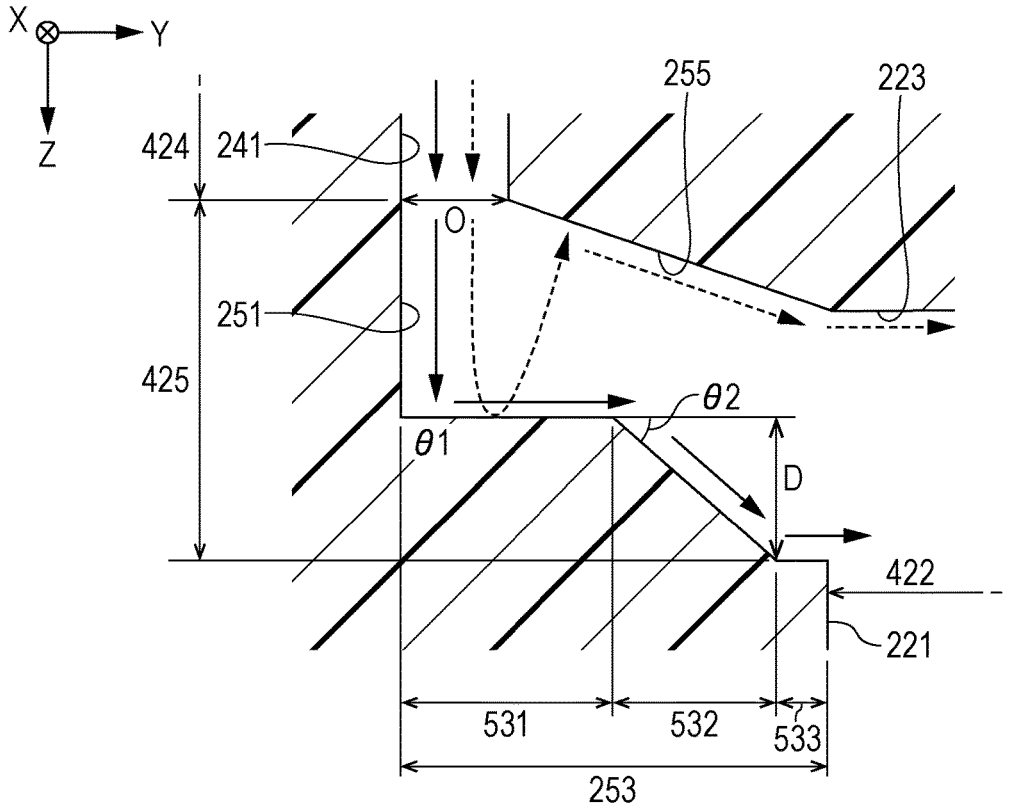
FIG. 5 is a sectional view of a first connecting flow path.

Hereinbelow, the shape of the first connecting flow path 425 will be described. FIG. 5 is an enlarged sectional view of the first connecting flow path 425 in FIG. 4. As shown in FIGS. 4 and 5, the first connecting flow path 425 includes a side wall surface 251, a bottom surface 253, and a top surface 255. In the first connecting flow path 425, the bottom surface 253 is located on the lower side in the vertical direction, and the top surface 255 is located on the upper side in the vertical direction. In other words, in the first connecting flow path 425, the surface located on the +Z-side is the bottom surface 253, and the surface located on the −Z-axis side is the top surface 255.

The side wall surface 251 of the first connecting flow path 425 is a surface continuous with the inner circumferential surface 241 of the supply flow path 424. The side wall surface 251 according to the first embodiment is formed along the Z axis. In the side wall surface 251, the −Z-side edge joins the lower edge of the inner circumferential surface 241 of the supply flow path 424 in the vertical direction, and the +Z-side edge joins the bottom surface 253.

More specifically, the top surface 255 of the first connecting flow path 425 is formed so as to extend from the inner circumferential surface 241 of the supply flow path 424 to a top surface 223 of the second liquid chamber 422. The −Y-side edge of the top surface 255 of the first connecting flow path 425 joins the lower edge, in the vertical direction, of the inner circumferential surface 241 of the supply flow path 424. The +Y-side edge of the top surface 255 joins the −Y-side edge of the top surface 223 of the second liquid chamber 422. The top surface 255 according to the first embodiment is inclined downward with respect to the horizontal plane. More specifically, the top surface 255 is an inclined surface whose +Y-side edge is located below the −Y-side edge. The horizontal plane is a plane perpendicular to the vertical direction, that is, a plane parallel to the X-Y plane.

The bottom surface 253 of the first connecting flow path 425 is formed so as to extend from the side wall surface 251 to the inner circumferential surface 221 of the second liquid chamber 422. The −Y-side edge of the bottom surface 253 joins the +Z-side edge of the side wall surface 251. The +Y-side edge of the bottom surface 253 joins the −Y-side edge of the inner circumferential surface 221 of the second liquid chamber 422. The bottom surface 253 according to the first embodiment includes a first supply bottom surface 531, a second supply bottom surface 532, and a third supply bottom surface 533. The first supply bottom surface 531, the second supply bottom surface 532, and the third supply bottom surface 533 are positioned in this order from the −Y-axis side to the +Y-axis side. In other words, the first supply bottom surface 531, the second supply bottom surface 532, and the third supply bottom surface 533 are positioned in this order from the upstream side to the downstream side of the ink flow. In still other words, the first supply bottom surface 531 is closest to the supply flow path 424, the third supply bottom surface 533 is closest to the second liquid chamber 422, and the second supply bottom surface 532 is located between the first supply bottom surface 531 and the third supply bottom surface 533. The second supply bottom surface 532 is located closer to the second liquid chamber 422 than the first supply bottom surface 531 is, and the third supply bottom surface 533 is located closer to the second liquid chamber 422 than the second supply bottom surface 532 is.

In the first embodiment, the first supply bottom surface 531 and the second supply bottom surface 532 are continuous, and the second supply bottom surface 532 and the third supply bottom surface 533 are continuous. More specifically, the +Y-side edge of the first supply bottom surface 531 joins the −Y-side edge of the second supply bottom surface 532, and the +Y-side edge of the second supply bottom surface 532 joins the −Y-side edge of the third supply bottom surface 533. The +Y-side edge of the third supply bottom surface 533 joins the −Y-side inner circumferential surface 221 of the second liquid chamber 422.

As shown in FIG. 5, the first supply bottom surface 531 is located below the supply flow path 424 in the vertical direction. Specifically, the first supply bottom surface 531 is located on the extension of the central axis of the supply flow path 424. In other words, the first supply bottom surface 531 faces an opening O, which is located at the end of the supply flow path 424 adjacent to the first connecting flow path 425. In sectional view as viewed in the X-axis direction, the width of the first supply bottom surface 531 is larger than the width of the opening O. For example, the width of the first supply bottom surface 531 in the Y-axis direction is about twice the width of the opening O.

In the description below, the angle formed between the first supply bottom surface 531 and the horizontal plane will be referred to as a "first angle θ1", and the angle formed between the second supply bottom surface 532 and the horizontal plane will be referred to as a "second angle θ2". More specifically, the first angle θ1 is an angle formed between the first supply bottom surface 531 and the horizontal plane passing through the edge of the first supply bottom surface 531 adjacent to the side wall surface 251. The first angle θ1 according to the first embodiment is greater than or equal to 0 degrees and less than 20 degrees. In the first embodiment, the first angle θ1 is 0 degrees. The angle formed between the third supply bottom surface 533 and the horizontal plane is also 0 degrees. More specifically, the angle formed between the third supply bottom surface 533 and the horizontal plane passing through the edge of the third supply bottom surface 533 adjacent to the second supply bottom surface 532 is 0 degrees. As is understood from above, the first supply bottom surface 531 and the third supply bottom surface 533 are surfaces parallel to the horizontal plane. In other words, the first supply bottom surface 531 and the third supply bottom surface 533 are surfaces inclined downward by 0 degrees with respect to the horizontal plane, from the supply flow path 424 toward the second liquid chamber 422. In still other words, the first supply bottom surface 531 and the third supply bottom surface 533 are inclined by 0 degrees from the upstream side to the downstream side of the ink flow; that is, the surfaces that are inclined downward by 0 degrees toward the +Y side are the first supply bottom surface 531 and the third supply bottom surface 533.

The second angle θ2 is an angle formed between the horizontal plane and a surface inclined downward from the supply flow path 424 toward the second liquid chamber 422 and is greater than the first angle θ1. More specifically, the second angle θ2 is an angle formed between the horizontal plane passing through the edge of the second supply bottom surface 532 adjacent to the first supply bottom surface 531 and an inclined surface inclined downward with respect to the horizontal plane passing through the edge of the second supply bottom surface 532 adjacent to the first supply bottom surface 531. In other words, the second supply bottom surface 532 is an inclined surface that is inclined downward with respect to the first supply bottom surface 531 or an inclined surface that is inclined upward with respect to the third supply bottom surface 533. That is, the second supply bottom surface 532 is an inclined surface whose +Y-side edge is located below the −Y-side edge. In other words, a surface inclined downward toward the +Y side is the second supply bottom surface 532. The second angle θ2 in the first embodiment is less than 90 degrees. FIG. 5 shows a case where the second angle θ2 is about 45 degrees. When viewed in the Y-axis direction, the first supply bottom surface 531, the second supply bottom surface 532, and the third supply bottom surface 533 are positioned in this order from top to bottom in the vertical direction. The height of the bottom surface 253 in the vertical direction decreases from the −Y-side edge toward the +Y-side edge.

As shown in FIG. 5, the edge of the second supply bottom surface 532 adjacent to the second liquid chamber 422 is located below the edge of the first supply bottom surface 531 adjacent to the second liquid chamber 422 by the distance D in the vertical direction. If the distance D is too short, the ink is difficult to flow into the liquid reservoir R. If the distance D is too long, an excessive amount of ink flows into the liquid reservoir R, allowing the bubbles in the ink to more easily flow into the liquid reservoir R. Hence, it is desirable that the distance D be from 0.6 mm to 1.2 mm. More preferably, the distance D is from 0.8 mm to 1.0 mm. However, the distance D is not limited to these examples.

Figure 6:
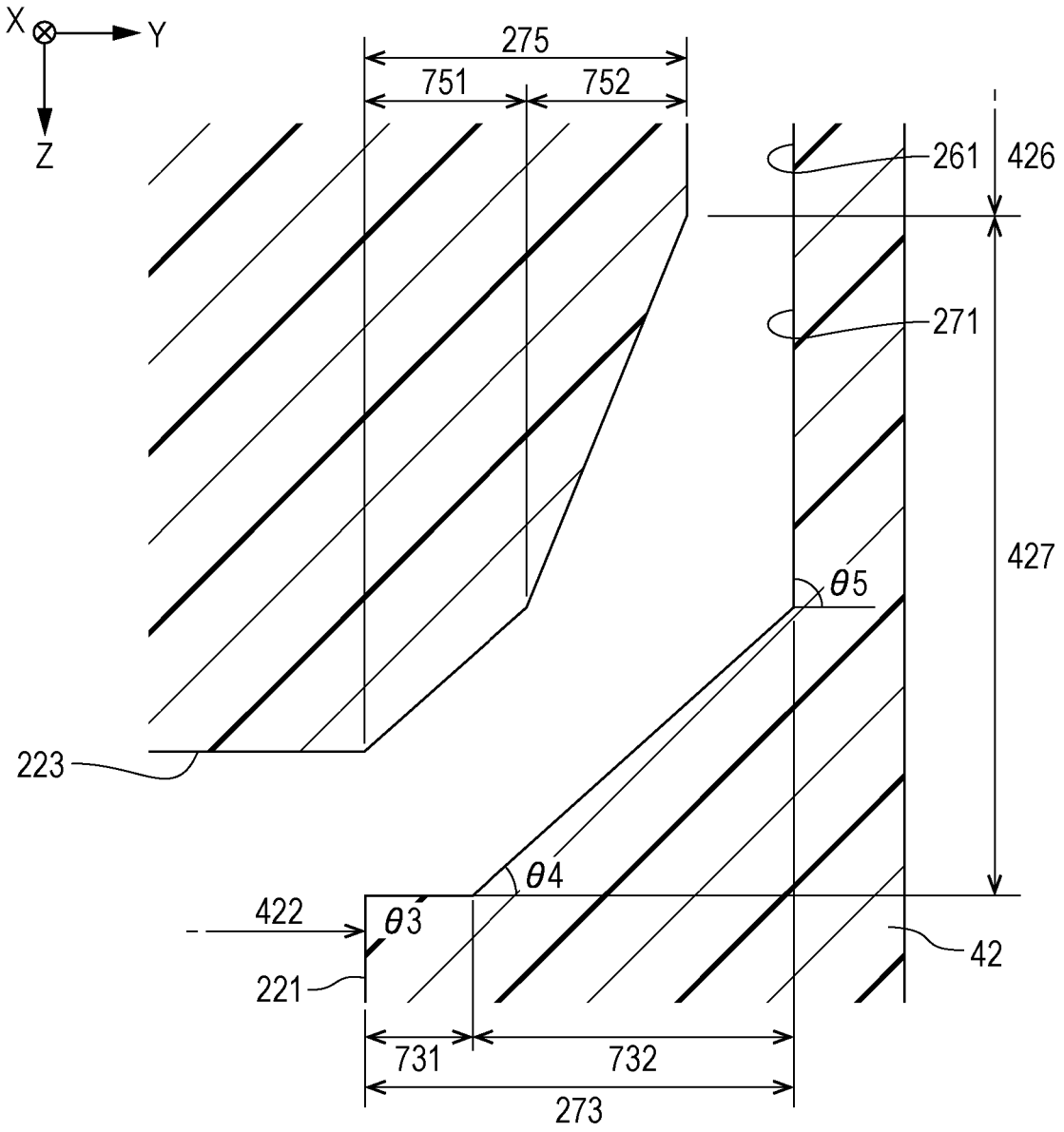
FIG. 6 is a sectional view of a second connecting flow path.

FIG. 6 is an enlarged sectional view of the second connecting flow path 427 in FIG. 4. As shown in FIG. 6, the second connecting flow path 427 has a different shape from the first connecting flow path 425. More specifically, the second connecting flow path 427 includes a side wall surface 271, a bottom surface 273, and a top surface 275.

The side wall surface 271 of the second connecting flow path 427 is formed so as to be continuous with an inner circumferential surface 261 of the discharging flow path 426. The side wall surface 271 in the first embodiment is formed parallel to the vertical direction. The −Z-side edge of the side wall surface 271 joins the lower edge, in the vertical direction, of the inner circumferential surface 261 of the discharging flow path 426, and the +Z-side edge of the side wall surface 271 joins the bottom surface 273.

The top surface 275 of the second connecting flow path 427 is formed so as to extend from the top surface 223 of the second liquid chamber 422 to the inner circumferential surface 261 of the discharging flow path 426. The edge of the top surface 275 adjacent to the second liquid chamber 422 joins the +Y-side edge of the top surface 223 of the second liquid chamber 422, and the edge of the top surface 275 adjacent to the discharging flow path 426 joins the +Z-side edge of the inner circumferential surface 261 of the discharging flow path 426. More specifically, the top surface 275 of the second connecting flow path 427 includes a first discharging top surface 751 and a second discharging top surface 752. The first discharging top surface 751 and the second discharging top surface 752 are formed so as to be continuous. The first discharging top surface 751 is located on the upstream side, and the second discharging top surface 752 is located on the downstream side in the ink flow direction.

The first discharging top surface 751 is an inclined surface whose edge adjacent to the discharging flow path 426 is located above the edge adjacent to the second liquid chamber 422. That is, the first discharging top surface 751 is inclined upward with respect to the horizontal plane passing through the edge of the first discharging top surface 751 adjacent to the second liquid chamber 422. The second discharging top surface 752 is an inclined surface whose edge adjacent to the discharging flow path 426 is located above the edge adjacent to the second liquid chamber 422. That is, the second discharging top surface 752 is inclined upward with respect to the horizontal plane passing through the edge of the second discharging top surface 752 adjacent to the second liquid chamber 422. In the first embodiment, the inclination angle of the second discharging top surface 752 with respect to the horizontal plane is greater than the inclination angle of the first discharging top surface 751 with respect to the horizontal plane.

The bottom surface 273 of the second connecting flow path 427 is formed so as to extend from the inner circumferential surface 221 of the second liquid chamber 422 to the side wall surface 271. The edge of the bottom surface 273 adjacent to the second liquid chamber 422 joins the +Y-side portion of the inner circumferential surface 221 of the second liquid chamber 422. The edge of the bottom surface 273 adjacent to the discharging flow path 426 joins the +Z-side edge of the side wall surface 271. The bottom surface 273 in the first embodiment includes a first discharging bottom surface 731 and a second discharging bottom surface 732. The first discharging bottom surface 731 and the second discharging bottom surface 732 are positioned in this order from the upstream side to the downstream side in the ink flow direction. In other words, the first discharging bottom surface 731 is located closer to the second liquid chamber 422 than the second discharging bottom surface 732 is.

The first discharging bottom surface 731 joins the inner circumferential surface 221 of the second liquid chamber 422 and the second discharging bottom surface 732. The second discharging bottom surface 732 joins the first discharging bottom surface 731 and the side wall surface 271. That is, in the first embodiment, the first discharging bottom surface 731 and the second discharging bottom surface 732 are continuous. More specifically, the edge of the first discharging bottom surface 731 farther from the second liquid chamber 422 joins the edge of the second discharging bottom surface 732 adjacent to the second liquid chamber 422. The side wall surface 271 joins the second discharging bottom surface 732 and the inner circumferential surface 261 of the discharging flow path 426.

As shown in FIG. 6, the first discharging bottom surface 731 is inclined upward with respect to the horizontal plane by a third angle θ3 from the second liquid chamber 422 toward the discharging flow path 426. The third angle θ3 is an angle formed between an inclined surface inclined upward and the horizontal plane passing through the edge of the first discharging bottom surface 731 adjacent to the second liquid chamber 422. More specifically, the third angle θ3 is 0 degrees. In other words, the first discharging bottom surface 731 is a surface parallel to the horizontal plane. The third angle θ3 is not limited to 0 degrees. The third angle θ3 may be any desired angle that is greater than or equal to 0 degrees.

The second discharging bottom surface 732 is inclined upward with respect to the horizontal plane by a fourth angle θ4 from the first discharging bottom surface 731 toward the discharging flow path 426. The fourth angle θ4 is an angle formed between an inclined surface inclined upward and the horizontal plane passing through the edge of the second discharging bottom surface 732 adjacent to the first discharging bottom surface 731. More specifically, the fourth angle θ4 is greater than or equal to the third angle θ3 and is less than 90 degrees. For example, the fourth angle θ4 is equal to the inclination angle of the first discharging top surface 751. In other words, the second discharging bottom surface 732 is an inclined surface that is inclined upward with respect to the first discharging bottom surface 731. When the third angle θ3 and the fourth angle θ4 are equal, the second discharging bottom surface 732 and the side wall surface 271 form a single continuous plane.

The side wall surface 271 is inclined upward with respect to the horizontal plane by a fifth angle θ5. The fifth angle θ5 is an angle formed between the side wall surface 271 and the horizontal plane passing through the edge of the side wall surface 271 adjacent to the second discharging bottom surface 732. More specifically, the fifth angle θ5 is greater than or equal to the fourth angle θ4. The fifth angle θ5 in the first embodiment is 90 degrees; that is, the side wall surface 271 is a plane perpendicular to the horizontal plane. When the fourth angle θ4 and the fifth angle θ5 are equal, the second discharging bottom surface 732 and the side wall surface 271 form a single continuous plane.

As shown in FIG. 4, the top surface 223 of the second liquid chamber 422 joins the first connecting flow path 425 at the −Y-axis side edge and joins the second connecting flow path 427 at the +Y-axis side edge. The top surface 223 of the second liquid chamber 422 in the first embodiment includes a first surface 231, a second surface 232, and a third surface 233. The first surface 231, the second surface 232, and the third surface 233 are positioned in this order from the −Y side to the +Y side. In other words, the first surface 231 is closest to the first connecting flow path 425, the third surface 233 is closest to the second connecting flow path 427, and the second surface 232 is located between the first surface 231 and the third surface 233.

The first surface 231 is continuous with the second surface 232, and the second surface 232 is continuous with the third surface 233. More specifically, the −Y-side edge of the first surface 231 joins the top surface 255 of the first connecting flow path 425, and the +Y-side edge of the first surface 231 joins the −Y-side edge of the second surface 232. The −Y-side edge of the third surface 233 joins the +Y-side edge of the second surface 232, and the +Y-side edge of the third surface 233 joins the top surface 275 of the second connecting flow path 427.

The first surface 231 is an inclined surface whose +Y-side edge is located above the −Y-side edge. In other words, the first surface 231 is inclined upward with respect to the horizontal plane passing through the −Y-side edge of the first surface 231. Because of the inclination of the first surface 231, the bubbles in the ink that have passed through the supply flow path 424 move along the first surface 231 to the vicinity of the discharging flow path 426. The second surface 232 is an inclined surface whose +Y-side edge is located below the −Y-side edge. In other words, the second surface 232 is inclined downward with respect to the horizontal plane passing through the −Y-side edge of the second surface 232. The third surface 233 is a horizontal plane. The shape of the top surface 223 in the second liquid chamber 422 is not limited to the example above. For example, the top surface 223 may be formed solely of an inclined surface whose +Y-side edge is located above the −Y-side edge, or the top surface 223 may be formed solely of a surface parallel to the horizontal plane.

Figure 7:
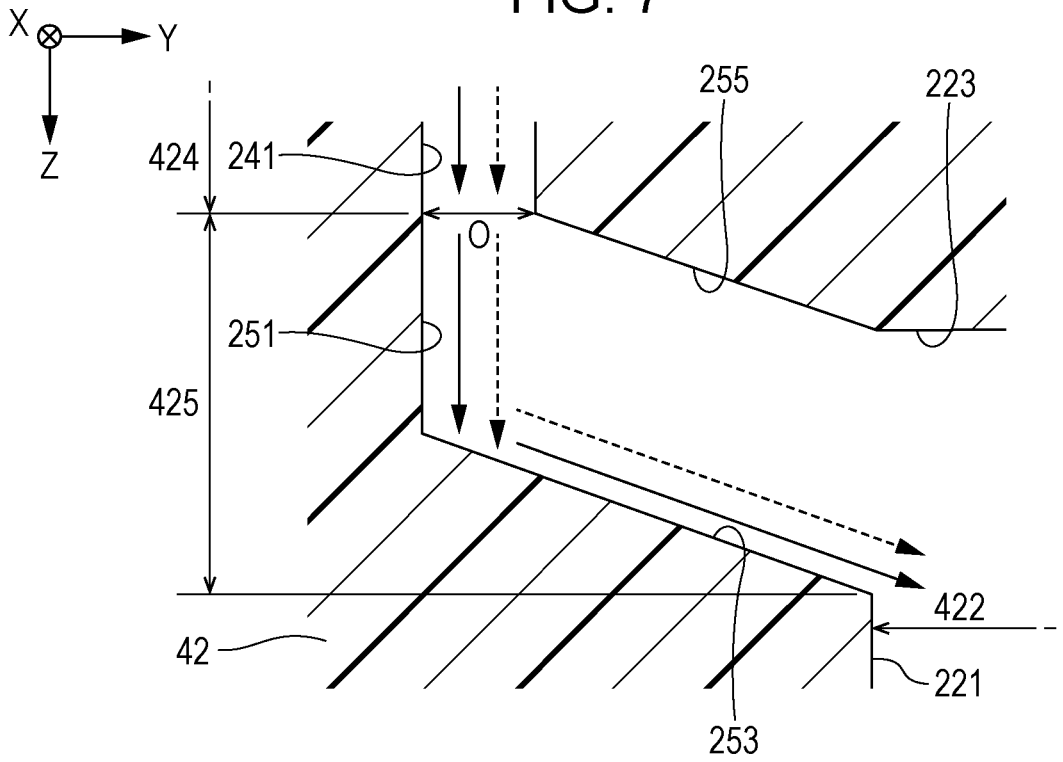
FIG. 7 is a sectional view of a first connecting flow path according to Comparative Example 1.

FIG. 7 is a sectional view of the first connecting flow path 425 in Comparative Example 1. In Comparative Example 1, the bottom surface 253 of the first connecting flow path 425 is inclined from the side wall surface 251 toward the second liquid chamber 422. That is, in Comparative Example 1, the bottom surface 253 of the first connecting flow path 425 is formed solely of the second supply bottom surface 532 in the first embodiment. As indicated by solid-line arrows, in the configuration of Comparative Example 1, although the ink that has passed through the first connecting flow path 425 smoothly flows into the liquid reservoir R along the bottom surface 253, the bubbles carried by the ink flow also easily flow into the pressure chambers C via the liquid reservoir R, as shown by dashed-line arrows.

Figure 8:
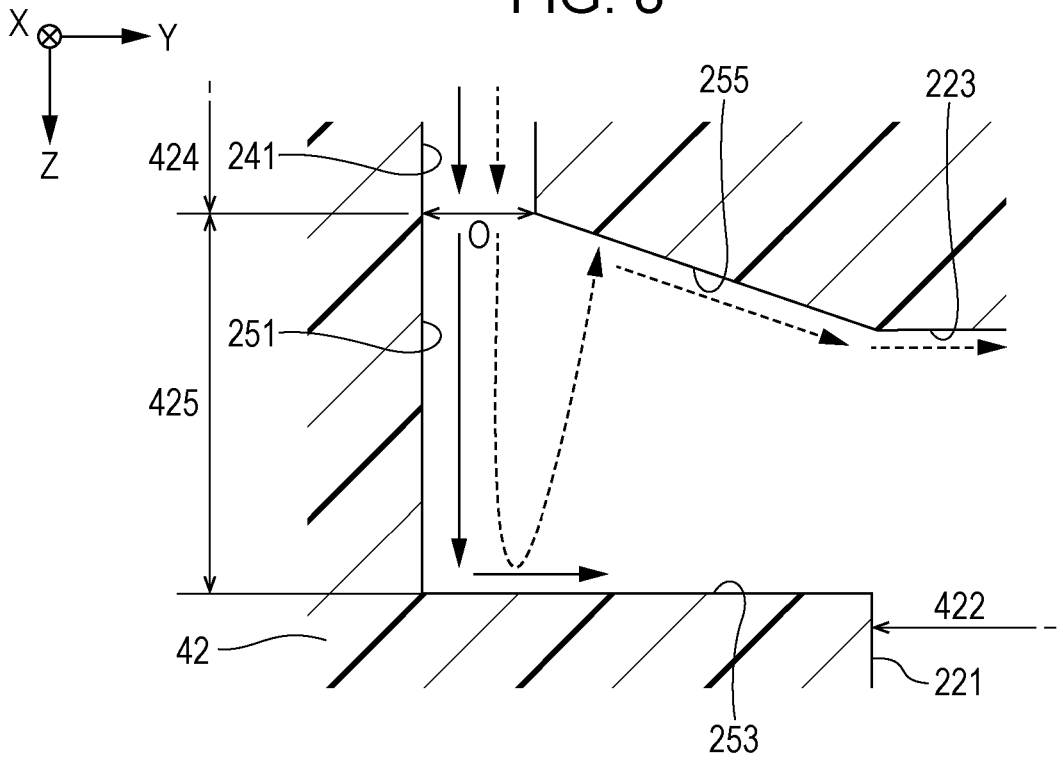
FIG. 8 is a sectional view of a first connecting flow path according to Comparative Example 2.

FIG. 8 is a sectional view of the first connecting flow path 425 in Comparative Example 2. In Comparative Example 2, the bottom surface 253 of the first connecting flow path 425 is formed of a horizontal surface extending from the side wall surface 251 to the second liquid chamber 422. That is, in Comparative Example 2, the bottom surface 253 of the first connecting flow path 425 is formed solely of the first supply bottom surface 531 in the first embodiment. As indicated by dashed-line arrows, in the configuration of Comparative Example 2, the bubbles that have passed through the supply flow path 424 collide with the bottom surface 253 of the first connecting flow path 425 and, as a result, float up toward the top surface 223 of the second liquid chamber 422. Hence, the bubbles are less likely to flow into the pressure chambers C. However, as shown by solid-line arrows, the ink that has passed through the supply flow path 424 collides with the bottom surface 253 of the first connecting flow path 425, which decreases the speed of ink flow and makes it difficult for the ink to flow into the liquid reservoir R. This leads to a problem in that the ink is not smoothly supplied to the pressure chambers C.

In contrast, in the first embodiment, the bottom surface 253 of the first connecting flow path 425 has the first supply bottom surface 531 that is parallel to the horizontal plane, and the second supply bottom surface 532 that is inclined downward by the second angle θ2, which is greater than the first angle θ1 and less than the 90 degrees, with respect to the horizontal plane. Accordingly, as shown by dashed-line arrows in FIG. 5, the bubbles that have passed through the supply flow path 424 and collided with the first supply bottom surface 531 float up toward the top surface 255 of the first connecting flow path 425. The floated bubbles move along the top surface 223 of the second liquid chamber 422 and are eventually discharged outside from the discharging flow path 426. That is, the bubbles are less likely to flow into the pressure chambers C. As shown by solid-line arrows in FIG. 5, the ink that has passed through the supply flow path 424 and collided with the first supply bottom surface 531 smoothly flow into the pressure chambers C along the second supply bottom surface 532 located below the first supply bottom surface 531. As is understood from the description above, the configuration of the first embodiment can inhibit the bubbles in the ink from flowing into the pressure chambers C without blocking the ink flow directed from the supply flow path 424 to the pressure chambers C.

In particular, in the first embodiment, because the first supply bottom surface 531 is located below the supply flow path 424 in the vertical direction, it is possible to effectively suppress the entrance of the bubbles into the pressure chambers C. Furthermore, the configuration of the first embodiment, in which the first supply bottom surface 531 is continuous the second supply bottom surface 532, has an advantage in that the ink that has passed through the supply flow path 424 smoothly flows into the pressure chambers C along the first supply bottom surface 531 and the second supply bottom surface 532.

B. Second Embodiment

A second embodiment will be described. In the examples below, components having the same functions as those in the first embodiment will be denoted by the same reference signs as used in the description of the first embodiment, and detailed descriptions thereof will be omitted where appropriate.

Figure 9:
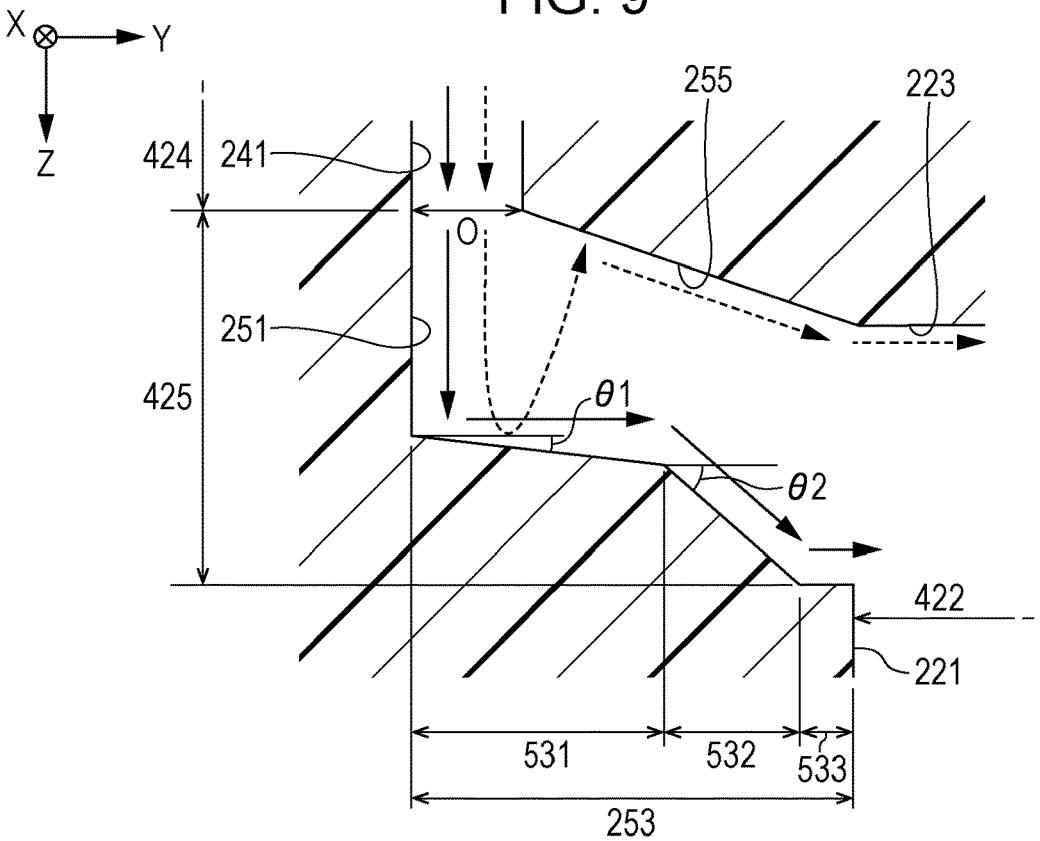
FIG. 9 is a sectional view of a first connecting flow path according to a second embodiment.

FIG. 9 is a sectional view of the first connecting flow path 425 according to the second embodiment. In the second embodiment, the shape of the bottom surface 253 of the first connecting flow path 425 is different from that in the first embodiment. More specifically, whereas the first supply bottom surface 531 in the first embodiment is parallel to the horizontal plane, the first supply bottom surface 531 in the second embodiment is inclined downward with respect to the horizontal plane from the supply flow path 424 toward the second liquid chamber 422. More specifically, the first supply bottom surface 531 is inclined downward with respect to the horizontal plane passing through the +Z-side edge of the side wall surface 251. The first angle θ1 in the second embodiment is greater than 0 degrees and less than 90 degrees. More specifically, the first angle θ1 is greater than 0 degrees and less than 20 degrees. Preferably, the first angle θ1 is less than 12 degrees. FIG. 9 shows an example case in which the first angle θ1 is about 10 degrees. The second angle θ2 at the second supply bottom surface 532 in the second embodiment is greater than twice the first angle θ1. The second angle θ2 is, for example, about 45 degrees, as in the first embodiment.

Also in the second embodiment, the same advantages as those in the first embodiment are achieved. In the configuration of the second embodiment, in which the first supply bottom surface 531 is an inclined surface that is inclined downward with respect to the horizontal plane by an angle greater than 0 degrees and less than 90 degrees, compared with a configuration in which, for example, the first supply bottom surface 531 is a surface parallel to the horizontal plane, it is possible to inhibit the ink that has passed through the supply flow path 424 and collided with the first supply bottom surface 531 from stagnating at the connection between the first supply bottom surface 531 and the side wall surface 251.

C. Modification

The above-described embodiments can be variously modified. Modifications applicable to the above-described embodiments will be described as examples below. Two or more aspects selected from the following examples may be combined as appropriate where they are consistent.

1. The first angle θ1 at the first supply bottom surface 531 and the second angle θ2 at the second supply bottom surface 532 are not limited to the examples described in the embodiments above. The first angle θ1 may be any angle that is greater than or equal to 0 degrees and less than 90 degrees. The second angle θ2 may also be any angle that is greater than the first angle θ1 and less than 90 degrees.

Figure 10:
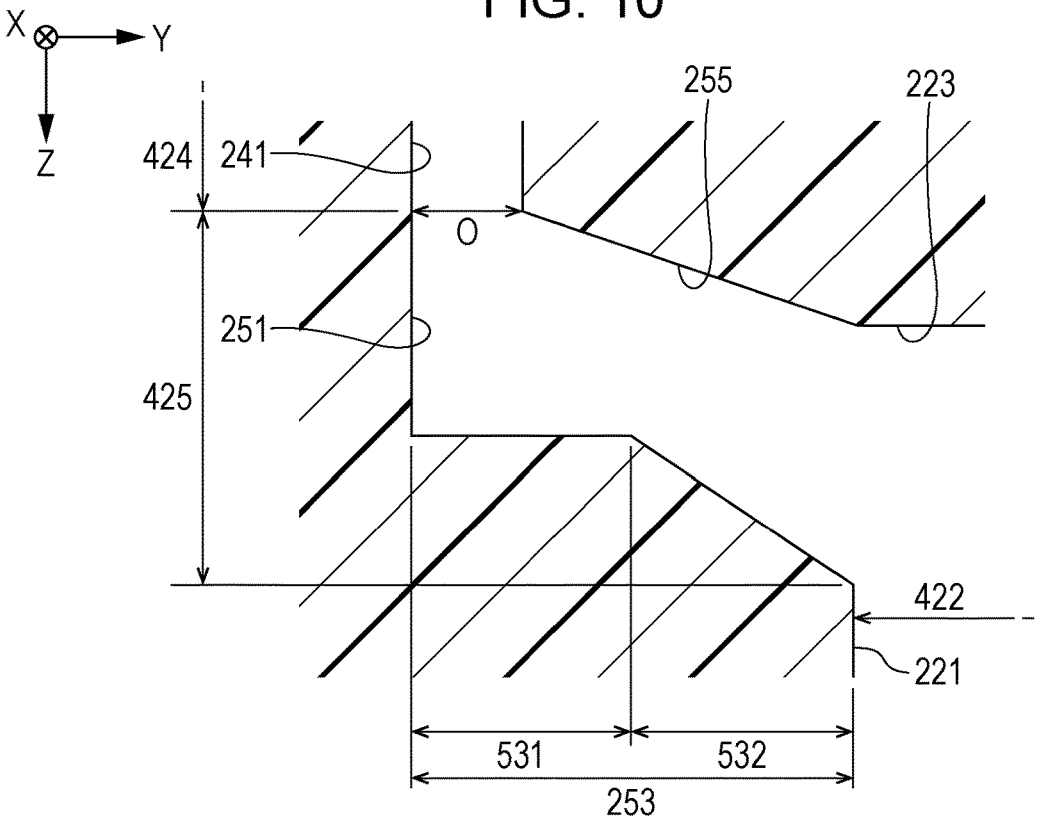
FIG. 10 is a sectional view of a first connecting flow path according to a modification.

2. In the above-described embodiments, an example configuration in which the bottom surface 253 of the first connecting flow path 425 includes the first supply bottom surface 531, the second supply bottom surface 532, and the third supply bottom surface 533 has been described. However, the shape of the bottom surface 253 of the first connecting flow path 425 is not limited thereto. For example, as shown in FIG. 10, it is possible that the bottom surface 253 of the first connecting flow path 425 do not have the third supply bottom surface 533. It is also possible that the bottom surface 253 include a surface that does not block the ink flow, in addition to the first supply bottom surface 531, the second supply bottom surface 532, and the third supply bottom surface 533. Examples of the surface that does not block the ink flow include a surface parallel to the horizontal plane, a surface inclined downward with respect to the horizontal plane from the supply flow path 424 toward the second liquid chamber 422, a curved surface, or the like. As is understood from the description above, another surface may be disposed between the first supply bottom surface 531 and the second supply bottom surface 532; that is, the first supply bottom surface 531 and the second supply bottom surface 532 do not need to be continuous.

Figure 11:
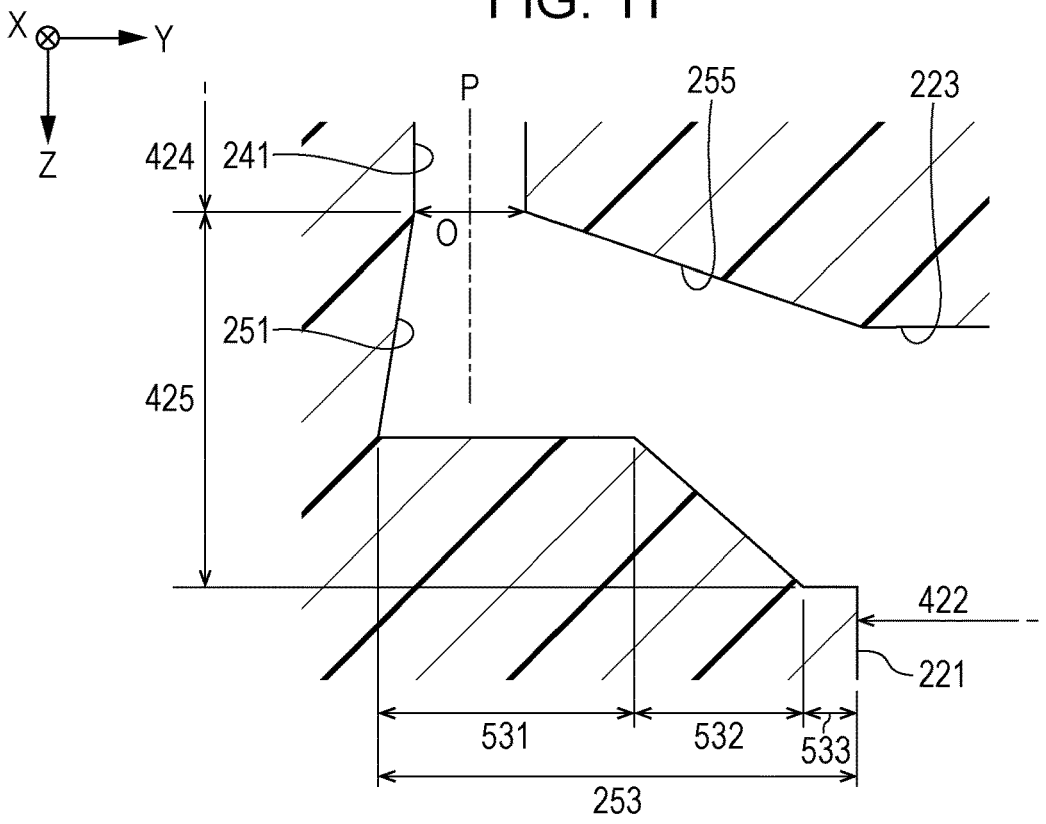
FIG. 11 is a sectional view of a first connecting flow path according to a modification.

3. In the above-described embodiments, a flat surface parallel to the vertical direction has been described as the side wall surface 251 of the first connecting flow path 425. However, for example, as shown in FIG. 11, the side wall surface 251 may be an inclined surface. For example, an inclined surface that is inclined such that the +Z-side edge is away from the second liquid chamber 422 may be used as the side wall surface 251.

Figure 12:
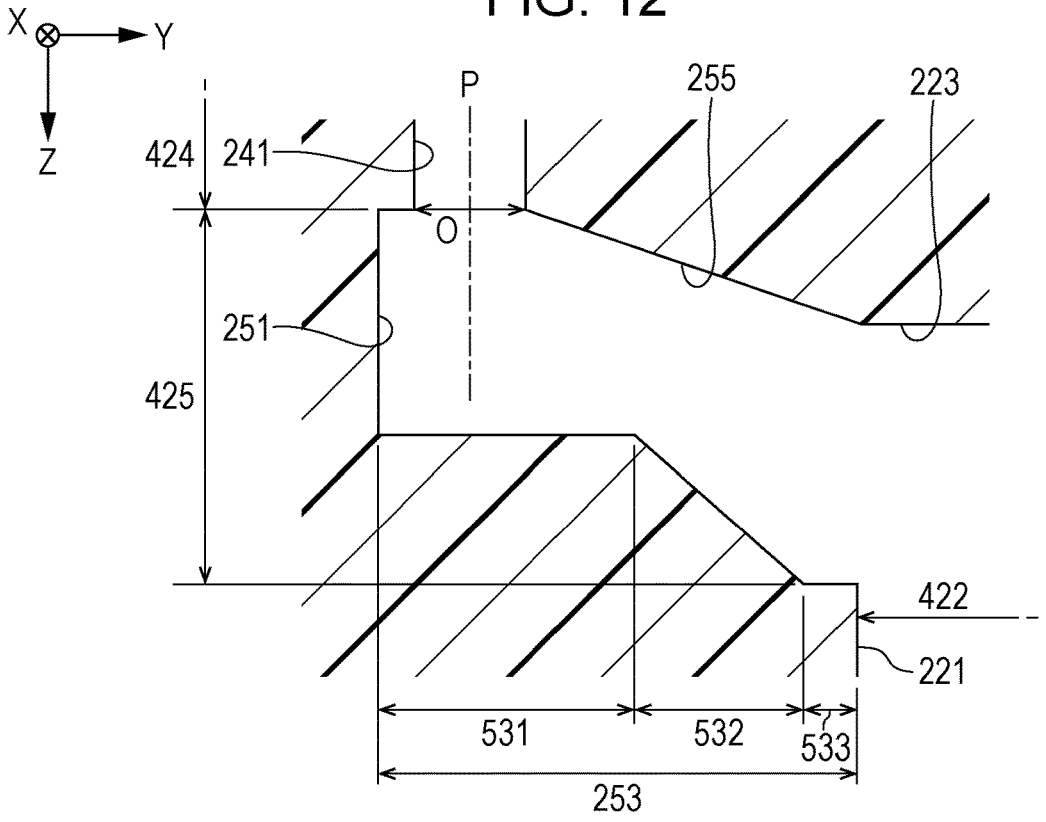
FIG. 12 is a sectional view of a first connecting flow path according to a modification.

4. In the above-described embodiments, the side wall surface 251 of the first connecting flow path 425 is formed so as to be continuous with the inner circumferential surface 241 of the supply flow path 424. However, the side wall surface 251 does not need to be continuous with the inner circumferential surface 241 of the supply flow path 424. For example, as shown in FIG. 12, the position of the side wall surface 251 of the first connecting flow path 425 and the position of the inner circumferential surface 241 of the supply flow path 424 in the Y-axis direction may be differentiated.

5. As shown in FIGS. 11 and 12, the first connecting flow path 425 may include a portion that is located further on the −Y-axis side than the opening O of the supply flow path 424 is. In other words, the −Y-side edge of the first supply bottom surface 531 may be located at a position further away from the central axis P of the supply flow path 424 than the periphery of the opening O is. The −X-side and +X-side edges of the first supply bottom surface 531 may be located at positions further away from the central axis P of the supply flow path 424 than the periphery of the opening O is. As is understood from the description above, the first supply bottom surface 531 may be formed over a larger area than the opening O, as viewed in the Z-axis direction.

Figure 13:
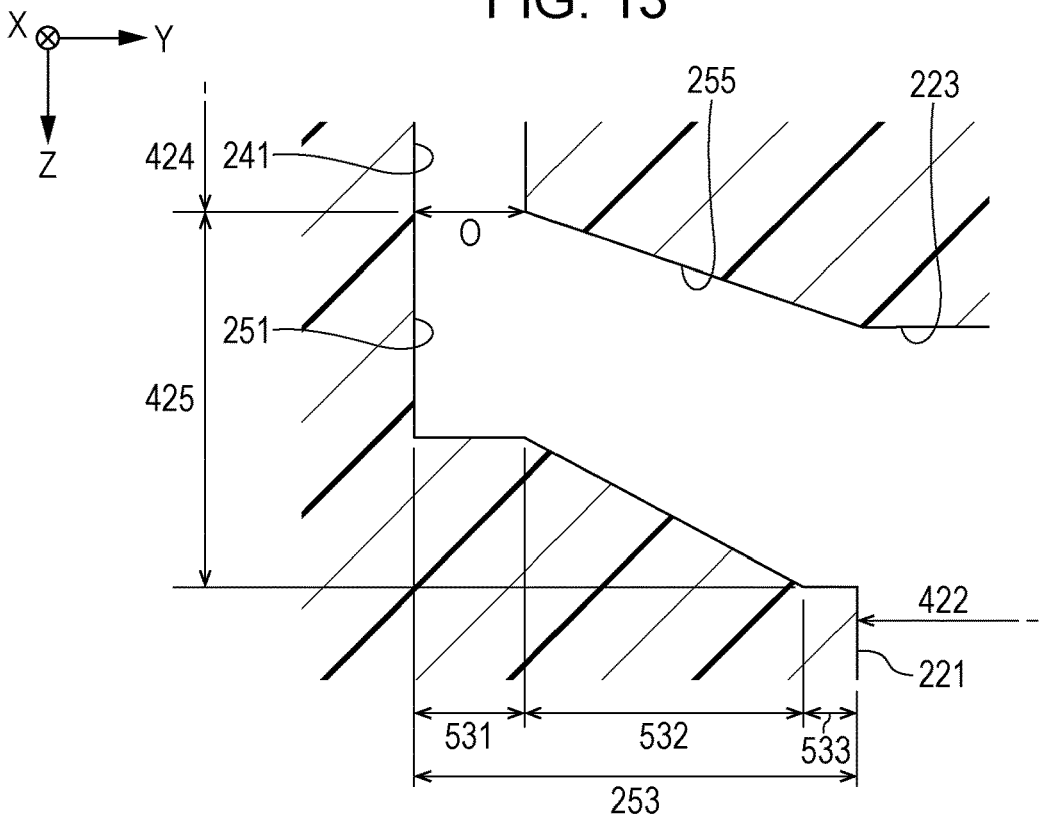
FIG. 13 is a sectional view of a first connecting flow path according to a modification.
Figure 14:
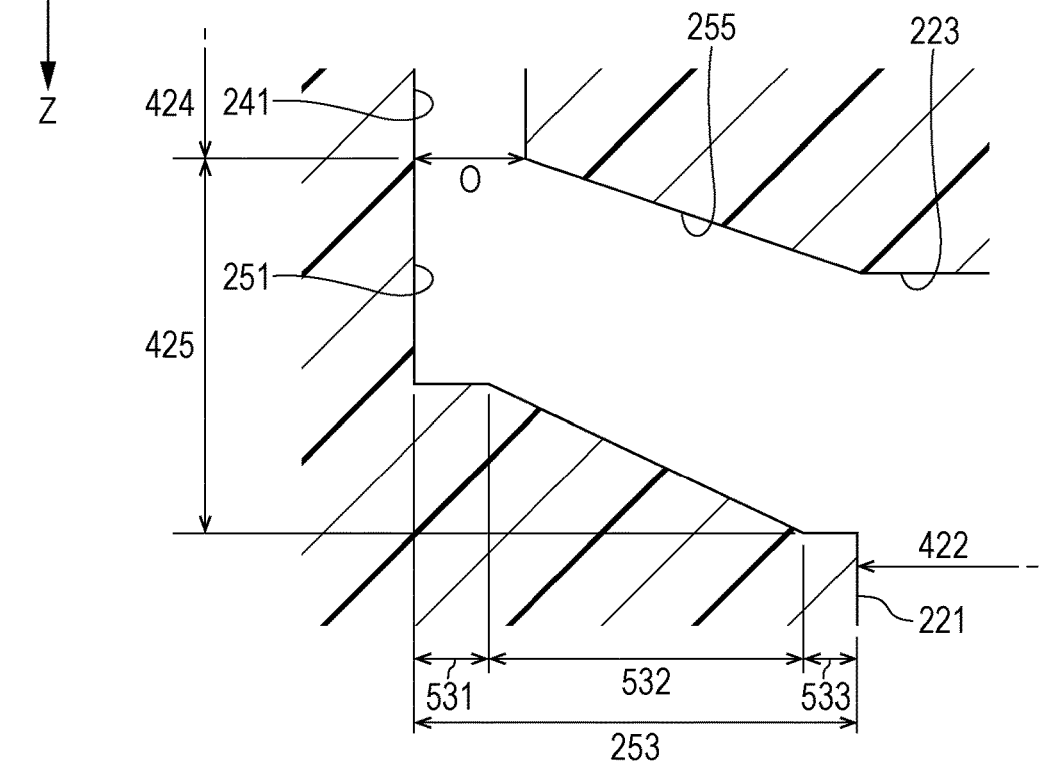
FIG. 14 is a sectional view of a first connecting flow path according to a modification.

6. In the above-described embodiments, although the width of the first supply bottom surface 531 in the Y-axis direction is about twice the width of the opening O, the width of the first supply bottom surface 531 in the Y-axis direction is not limited thereto. For example, the width of the first supply bottom surface 531 in the Y-axis direction may be equal to the width of the opening O, as shown in FIG. 13, or may be smaller than the width of the opening O, as shown in FIG. 14. However, from the standpoint of suppressing the entrance of bubbles in the ink into the pressure chambers C, a configuration in which the first supply bottom surface 531 is formed at at least a portion facing the opening O in the X-Y plane is preferred.

7. In the above-described embodiments, although the top surface 255 of the first connecting flow path 425 is an inclined surface, the first connecting flow path 425 may have any shape. For example, the top surface 255 may be a surface parallel to the horizontal plane, or the top surface 255 may include a plurality of surfaces having different inclinations.

8. The shape of the second connecting flow path 427 is not limited to one described in the above-described embodiments. For example, the bottom surface 273 of the second connecting flow path 427 may include a plurality of surfaces having different inclinations. Alternatively, an inclined surface may be used as the side wall surface 271 of the second connecting flow path 427.

9. In the above-described embodiments, although the supply flow path 424 is formed linearly so as to extend in the vertical direction, the supply flow path 424 may have any shape. For example, it is possible to employ a configuration in which the supply flow path 424 includes a portion inclined with respect to the vertical direction or a configuration in which the supply flow path 424 includes a portion extending linearly in the horizontal direction. The discharging flow path 426 may also have any shape. A member for preventing the bubbles that have flowed into the first connecting flow path 425 through the supply flow path 424 from returning to the supply flow path 424 may be provided near the opening O of the supply flow path 424.

10. In the above-described embodiments, the supply flow path 424 and the discharging flow path 426 may be formed in a member different from the housing portion 42. For example, a member having the supply flow path 424 and the discharging flow path 426 is coupled to the housing portion 42 having the second liquid chamber 422, the first connecting flow path 425, and the second connecting flow path 427.

11. The driving elements that eject the liquid in the pressure chambers C from the nozzles N are not limited to the piezoelectric elements 38, as described in the above-described embodiments. For example, it is possible to use, as the driving elements, heater elements that cause film boiling by means of heating, thus generating bubbles in the pressure chambers C and fluctuating the pressure. As is understood from this example, the driving elements are comprehensively expressed as elements that eject the liquid in the pressure chambers C from the nozzles N, and the operation method thereof (e.g., a piezoelectric method, a thermal method, or the like) and the detailed configuration thereof are not specifically limited. As is understood from the description above, the pressure chambers C are an example of energy generating chambers in which energy for discharging ink supplied from the liquid reservoir R is generated.

12. In the above-described embodiments, although the liquid discharge apparatus 100 of a serial type, in which the transport body 242 having the liquid discharge head 26 is reciprocated, has been described, the present disclosure may also be applied to a line-type liquid discharge apparatus, in which a plurality of nozzles N are distributed over the overall width of the medium 12.

13. The liquid discharge apparatus 100 described in the above-described embodiments can be applied to various apparatuses, such as a facsimile machine, a copier, and the like, besides apparatuses used solely for printing. The use of the liquid discharge apparatus of the present disclosure is not limited to printing. For example, a liquid discharge apparatus that ejects a colorant solution is used as an apparatus for producing color filters of liquid-crystal display devices. A liquid discharge apparatus that ejects a conducting-material solution is used as an apparatus for producing wires and electrodes of wiring boards.

What is claimed is:

1. A liquid discharge head comprising:

a liquid chamber storing liquid;

a supply flow path supplying the liquid to the liquid chamber;

a discharging flow path being provided away from the supply flow path in a horizontal direction and discharging the liquid from the liquid chamber;

a first connecting flow path communicating between the liquid chamber and the supply flow path; and nozzles for discharging the liquid supplied from the liquid chamber, wherein the first connecting flow path has a bottom surface including a first supply bottom surface and a second supply bottom surface, the first supply bottom surface inclines downward with respect to a horizontal plane at a first angle from the supply flow path toward the liquid chamber, the second supply bottom surface located between the first supply bottom surface and the liquid chamber and inclines downward with respect to the horizontal plane at a second angle from the first supply bottom surface toward the liquid chamber, the first angle is greater than or equal to 0 degrees and is less than 90 degrees, and the second angle is an angle greater than the first angle and is less than 90 degrees.

2. The liquid discharge head according to claim 1, wherein the first supply bottom surface is located in a vertical direction with respect to the supply flow path.

3. The liquid discharge head according to claim 1, wherein the first supply bottom surface and the second supply bottom surface are continuous.

4. The liquid discharge head according to claim 1, wherein the first angle is an angle greater than or equal to 0 degrees and less than 20 degrees.

5. The liquid discharge head according to claim 1, wherein the first angle is 0 degrees.

6. The liquid discharge head according to claim 1, wherein the first angle is greater than 0 degrees, and the second angle is an angle greater than twice the first angle.

7. The liquid discharge head according to claim 1, wherein an edge of the second supply bottom surface adjacent to the liquid chamber is located in a vertical direction with respect to an edge of the first supply bottom surface adjacent to the liquid chamber by a distance of 0.6 mm to 1.2 mm.

8. The liquid discharge head according to claim 1, further comprising a second connecting flow path communicating between the liquid chamber and the discharging flow path, wherein the second connecting flow path has a bottom surface including a first discharging bottom surface and a second discharging bottom surface, the first discharging bottom surface joined to an inner circumferential surface of the liquid chamber and inclines upward with respect to the horizontal plane at a third angle from the liquid chamber toward the discharging flow path, the second discharging bottom surface joined to the first discharging bottom surface and inclines upward with respect to the horizontal plane at a fourth angle from the first discharging bottom surface toward the discharging flow path, the third angle is greater than or equal to 0 degrees, the fourth angle is an angle greater than or equal to the third angle and is less than 90 degrees, and the second connecting flow path has a side wall surface joined to the second discharging bottom surface and an inner circumferential surface of the discharging flow path and inclined upward with respect to the horizontal plane at a fifth angle that is greater than or equal to the fourth angle.

9. The liquid discharge head according to claim 1, wherein the first supply bottom surface is located in a vertical direction with respect to the supply flow path, and the first supply bottom surface and the second supply bottom surface are continuous.

10. The liquid discharge head according to claim 1, wherein the first supply bottom surface is located in a vertical direction with respect to the supply flow path, and the first angle is an angle greater than or equal to 0 degrees and less than 20 degrees.

11. The liquid discharge head according to claim 1, wherein the first supply bottom surface is located in a vertical direction with respect to the supply flow path, and the first angle is 0 degrees.

12. The liquid discharge head according to claim 1, wherein the first supply bottom surface is located in a vertical direction with respect to the supply flow path, the first angle is greater than 0 degrees, and the second angle is an angle greater than twice the first angle.

13. The liquid discharge head according to claim 1, wherein the first supply bottom surface and the second supply bottom surface are continuous, and the first angle is an angle greater than or equal to 0 degrees and less than 20 degrees.

14. The liquid discharge head according to claim 1, wherein the first supply bottom surface and the second supply bottom surface are continuous, and the first angle is 0 degrees.

15. The liquid discharge head according to claim 1, wherein the first supply bottom surface is located in a vertical direction with respect to the supply flow path, the first supply bottom surface and the second supply bottom surface are continuous, and the first angle is an angle greater than or equal to 0 degrees and less than 20 degrees.

16. The liquid discharge head according to claim 1, wherein the first supply bottom surface is located in the supply flow path in a vertical direction with respect to the supply flow path, the first supply bottom surface and the second supply bottom surface are continuous, and the first angle is 0 degrees.

17. A liquid discharge apparatus comprising:

the liquid discharge head according to claim 1; and a controller controlling the liquid discharge head.

* * * * *